US005605720A

United States Patent [19]

Allen et al.

[11] Patent Number: 5,605,720

[45] Date of Patent: Feb. 25, 1997

[54] METHOD OF CONTINUOUSLY FORMULATING AND APPLYING A HOT MELT ADHESIVE

[75] Inventors: Martin A. Allen, Dawsonville; John T. Fetcko, Cumming, both of Ga.

[73] Assignee: J & M Laboratories Inc., Dawsonville, Ga.

[21] Appl. No.: 626,048

[22] Filed: Apr. 4, 1996

[51] Int. Cl.[6] ..... B05D 5/00

[52] U.S. Cl. ..... 427/288; 427/421; 427/430.1; 427/439

*Primary Examiner*—Bernard Pianalto
*Attorney, Agent, or Firm*—R. L. Graham

[57] ABSTRACT

An in-line continuous method of formulating and applying a hot melt adhesive to a substrate involves metering a particulate polymer adhesive and a tackifier in a weight ratio in an extruder where the raw materials are formed into a homogeneous melt. The melt is continuously discharged directly into a hot melt applicator for deposition onto a substrate.

14 Claims, 5 Drawing Sheets

METHOD OF CONTINUOUSLY FORMULATING AND APPLYING A HOT MELT ADHESIVE

BACKGROUND OF THE INVENTION

This invention relates generally to hot melt adhesives and, in particular, to a method of formulating and applying hot melt adhesives in a continuous in-line operation. In one aspect, this invention relates to the formulation and application of an adhesive onto a diaper backsheet.

Hot melt adhesives are blends of several raw materials including polymers, resins, plasticizers and other additives such as antioxidants, fillers, pigments, etc. Since these ingredients must be blended in the proper ratio to obtain the adhesive having the desired properties, it has been the practice of the industry to batch blend the raw materials in a mechanical mixer under controlled conditions to obtain a thoroughly mixed product. The blended product is then discharged as an amorphous melt, collected, and packaged for storage and shipment to the end user. The end user transfers the solid formulated adhesive to a melt tank for feeding a hot melt applicator. This approach is inefficient and costly for the following reasons:

(a) the adhesive must be remelted at the location of use, requiring energy and specialized melting equipment;

(b) the adhesive must contain an antioxidant to prevent degradation of the adhesive during the remelting and application process and during long periods of storage;

(c) the formulation cannot be modified at the point of use;

(d) the quality of adhesive may suffer during storage or transport due to polymer degradation or contamination;

(e) plasticizers are required to ensure viscosity stability during the remelt and application process.

In certain operations where large volumes of adhesives are used, such as in label coating, tape manufacture, or diaper chasis, the operator sometimes employs an in-line system comprising a batch mechanical mixer (e.g. Banbury mixer). In this process, the adhesive ingredients are batch mixed in the mixer until a homogeneous adhesive formulation (typically 2,000 to 5,000 pound batches) is obtained. The mixing is then discontinued and the adhesive formulation is discharged from the mixer to a pump and then pumped through heated lines to a roll coater for application on a coated stock. The present invention offers significant advantages over the batch prior art process, as well as the fully formulated approach described above. The continuous operation of the present invention ensures uninterrupted operation of the line and eliminates the packaging and shipping costs. Moreover, the continuous process is especially adapted to air assisted adhesive applicators, which is the preferred embodiment of the present invention.

SUMMARY OF THE INVENTION

The method of the present invention involves the continuous formulation and application of a hot melt adhesive utilizing (a) an extruder for blending the adhesive raw materials to form a homogeneous melt, and (b) a hot melt applicator system connected to and operated in line with the extruder.

The in-line operation comprises the following steps:

(a) continuously metering into the barrel of an extruder raw materials Comprising particles of a polymer adhesive and a resin in the proper weight ratio;

(b) heating and mixing the raw materials in the extruder to form a homogeneous melt of the raw materials;

(c) continuously discharging the melt from the extruder directly into an applicator system comprising a plurality of applicators, each applicator having a pump and an applicator head;

(d) discharging the melt from the applicator heads onto a substrate.

The extruder is preferably a twin-screw extruder and the adhesive applicators are preferably air assisted, most preferably meltblowing applicators, such as meltblowing dies.

In a specific embodiment of the present invention, the in-line formulation and application is used in the manufacture of diapers where a predetermined pattern is applied to diaper backsheet using air assisted dies.

DESCRIPTION OF THE PREFERRED EMBODIMENTS

Figure 1:
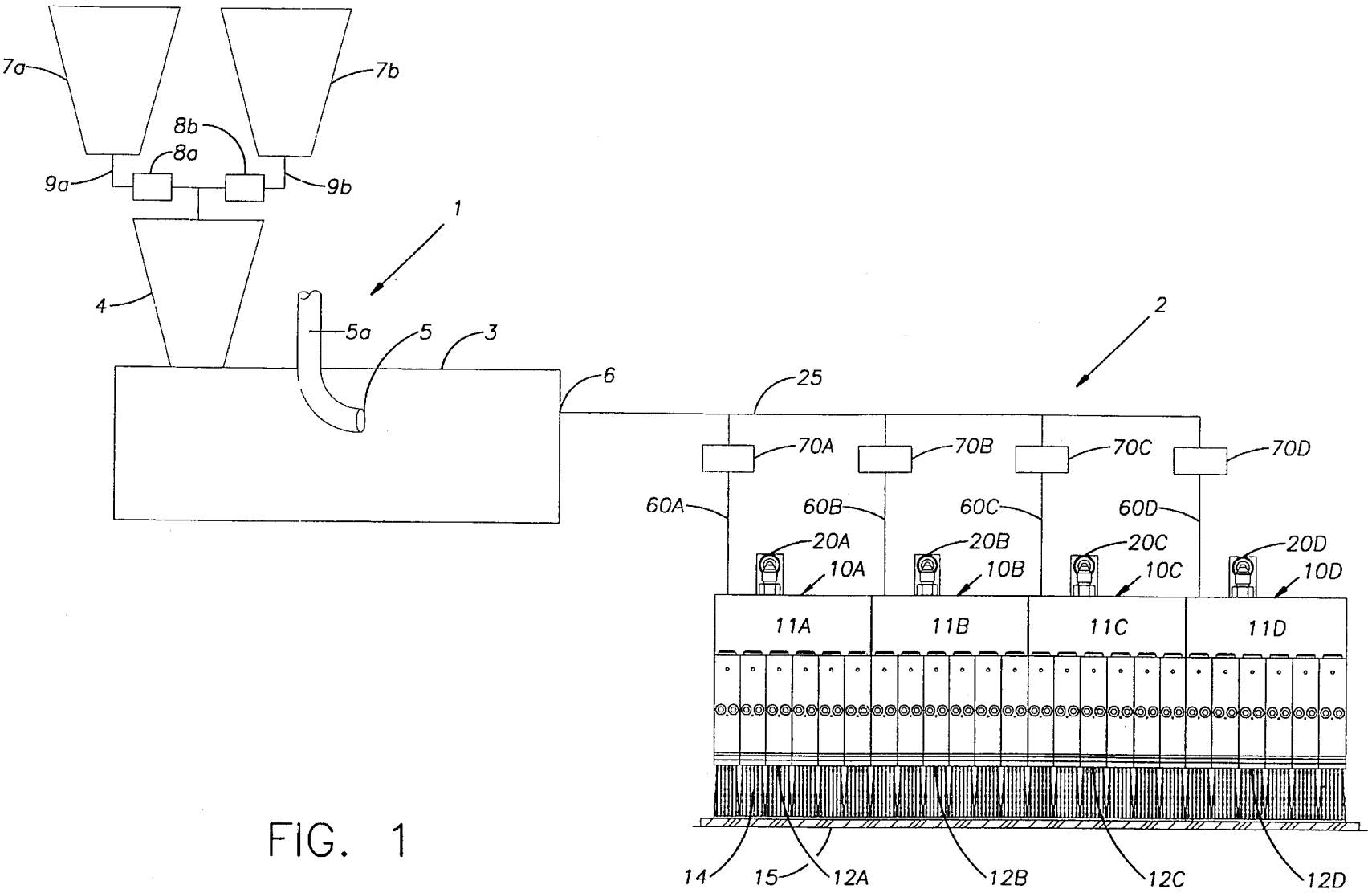
FIG. 1 is a schematic of the system for continuously formulating and applying a hot melt adhesive according to the present invention.

A novel feature of the present invention is that it involves (a) the continuous formulation of raw materials into a hot melt adhesive blend and (b) application of the hot melt adhesive blend onto a substrate. The method relies on the selection and formulation of proper raw materials, design of the proper system, and proper operations.

Raw Materials

Although a large number of additives have been developed for use in hot melt adhesive formulations, the present invention, because of its continuous operation, permits reduction and even the elimination of some of the additives. Moreover, the method results in an improved adhesive because its use immediately after formulation avoids polymer degradation or contamination.

The method employs only two basic raw materials: (1) adhesive polymer and (2) tackifier resin. Optionally, additives such as plasticizers, antioxidants, fillers, pigments, dyes and waxes may be used. When plasticizer and/or antioxidants are used,.their quantity is greatly reduced over the prior art because of the continuous operation.

Any of the hot melt adhesive polymers may be used in the method of the present invention. These include the following:

block copolymers:

SIS—Styrene-Isoprene-Styrene

SBS—Styrene-Butadiene-Styrene

SEBS—Styrene-Ethylene-Butadiene-Styrene

Ethylene vinyl acetate copolymers containing from 10 to 60 wt% VA

Polyolefins—Specialty grades of polyethylene and polypropylene

Other:

polyurethane

EMA (ethyl-methacrylate copolymer)

Amorphous PP

Polyamide

The preferred adhesive polymers are EVA's and the block copolymers. These adhesives are commercially available under various trade names (e.g. Kraton, Vector, Escorene and Stereon) from a variety of suppliers including Shell Chemical Co., Exxon Chemical Co., and ATO North America, Inc. These adhesive polymers are available in granular or particulate form, as a melt, and as a solid mass.

The other essential raw material, tackifier resin, imparts tack to the adhesive, and may also improve its cohesive strength, decrease its viscosity, enhance wetting, and change its softening point. These polymers are made by polymerizing olefins or diolefins by aluminum chloride polymerization of aliphatic and/or aromatic streams, or by thermal polymerization of cyclodiene streams, then hydrogenation. The degree of polymerization is about 10.

The hydrocarbon tackifiers are low molecular weight, amorphous, thermoplastic polymers derived from synthetic or natural monomers. The tackifiers may be classified according to the following types:

| Type | Monomer |
|---|---|
| Petroleum | trans pentadiene styrene, or 2-methyl-2 butene |
| Terpene | limonene or B-Pinene |
| Rosen | abietic acid |

These hydrocarbon tackifiers are available from a number of manufacturers including Exxon Chemical Co. who markets the tackifiers under trade designations ESCOREZ 1000, 2000, 5000, 7000, and 9000, and ECR-1XX. The tackifier resins are generally available in particulate form.

A second major class of tackifiers include tall oil resin esters (TORE) to decrease hardness and modulus as well as to reduce costs.

In some applications, it may be necessary to use modifiers (e.g. plasticizers) to improve the rheology of the adhesive. A common modifier is mineral oil. Another common modifier is wax.

Other raw material additives that can be introduced into the extruder include the following:

(a) antioxidants such as (i) alkylated phenols and bisphenols (e.g. butylated hydroxy toluene), sold under trade designations BHT, Irganox 1010 and 1035, and Isonox 132, and (ii) amines sold under trade designations Novgard A and BG;

(b) inorganic fillers such as calcium carbonate, talc, silica, and similar materials;

(c) pigments such as carbon black and titanium dioxide;

(d) dyes; and (e) waxes.

The raw materials will be mixed in the extruder to form a substantially homogeneous melt. A typical mixture will include the following ingredients:

| | Range | Preferred | Most Preferred |
|---|---|---|---|
| Polymer | 10–60 wt % | 15–50 wt % | 20–45 wt % |
| Tackifier | 30–90 wt % | 35–65 wt % | 45–60 wt % |
| Other (e.g. oils, waxes, fillers, etc.) | 0–30 wt % | 5–25 wt % | 5–20 wt % |

The weight ratios of the polymer: tackifier ranges from 10:90 to 2:1, preferably 20:80 to 50:50.

Equipment

As indicted above, the apparatus for carrying out the invention includes two main components:

(a) a twin screw extruder, and (b) a hot melt applicator system for depositing hot melt onto a substrate.

The twin screw extruder may be any of the several commercially available constructions that are capable of mixing and melting the raw materials to form a substantially uniform adhesive melt. The preferred extruder has twin-intermeshing screws for dispersive mixing. The twin screws may be corotating or counterrotating. The extruder is preferably provided with hopper feed and side feed ports. The hopper feed and side feed ports (if used) must be capable of continuously metering the raw materials into the extruder at the proper weight ratios.

In a preferred embodiment in which two particulate raw materials (e.g. polymer and resin) are to be blended, the extruder hopper will include facilities for feeding the two ingredients into the extruder at the proper weight ratio. Such facilities may include two hoppers, each of which feeds a conveyor that is operated to provide the proper weight ratios. Where precise ratios are needed, each hopper may be provided with a weigh feeder.

The weigh feeder may be a loss-in-weight, or gain-in-weight, weigh belt, or volumetric feeder, or any of the other weigh feeders commercially available. Weigh feeder manufacturers include K-Tron North America, Conair Franklin, Pacific Engineering, Foremost Machine Builders, Inc., and Thayer Scale Div., Hyes Industries.

In an alternative embodiment in which one or two particulate raw materials are added via the hopper and a liquid is added via a side feed port, the side feed port will include a pump such as a gear pump to feed the liquid ingredient at the proper weight ratio vis-a-vis the other raw materials.

The extruder and associated equipment may be controlled by electronic feedback control systems for monitoring temperature, motor speeds, and lubrication, as well as feed rates, shaft speed, torque, output rates, oil level, etc. Different systems may have different control systems.

The extruder is provided with heaters whereby energy input from the rotating screws and heaters melt and blend the raw materials to form a substantially uniform hot melt. The melt is discharged continuously from the extruder and conveyed in a heated line to the hot melt applicators.

Depending on the design selected, the applicators may deposit the adhesive onto the substrate in the form of a bead, a spiral bead, or a meltblown, including sprayed filaments or particles in a random pattern. These applications may include a gear pump for accurately pumping and metering adhesive to the applicator dies. The adhesive applicator may be any of those described at length in the patent literature. See for examples U.S. Pat. Nos. 5,145,689, 5,236,641, 4,687,137, 4,785,996, 4,891,249, and 5,160,746, and PCT Application No. PCT/US06454, the disclosures of which are incorporated herein by reference.

Because of their versatility and wide use, the preferred applicator is an air assisted applicator which has an applicator head for discharging a melt into an air stream which conveys the adhesive onto the substrate. The adhesive deposited on the substrate may be by a swirl or spiral pattern, random fiber pattern, or sprayed particles. As described in more detail below, the most preferred applicator head is a meltblowing die. One example of such die is described in U.S. Pat. Nos. 5,145,689 and 5,236,641, the disclosures of which are incorporated herein by reference.

An illustrative embodiment of the present invention will be described with reference to the drawings, wherein numeral 1 represents the extruder assembly (including accessories) and numeral 2 represents the adhesive applicator system.

As seen in FIG. 1, extruder 3 of assembly 1 is a twin screw extruder having hopper feed 4, side feed port 5, and outlet 6. The extruder hopper 4 is fed by twin hoppers 7*a* and 7*b* through lines 9*a* and 9*b* having metering feeders 8*a* and 8*b*. The feeders 8*a* and 8*b* may be conveyor screws or weigh feeders, both of which are adapted to feed raw particulate or granular materials from hoppers 7*a* and 7*b* into hopper 4 in the proper weight ratio. Liquid additives may be pumped into port 5 through flow line 5*a* connected to the port as shown. Multiple ports 5 may be provided for introducing various additives.

The particulate raw materials are mixed and melted in the extruder 3 and discharged at extruder outlet 6 into main line 25 as a homogeneous melt. Line 25 may be a pipe or flexible hose heated by jacket heating elements (not shown). Main line 25 conducts the melt to the applicator system 2 which may take a variety of forms as mentioned previously. The size (diameter) of line 25 will depend on the output capacity of the extruder 3, the length of line 25, and demand of the applicator system. Typically, line 25 will be from ¼ to 3 inches ID and from 5 to 100 feet in length. In the illustration of FIG. 1, line 25 feeds the polymer melt to a plurality of applicator units 10A, 10B, 10C, and 10D in parallel. Each of these units includes pump 70, actuator 20, manifold 11, and meltblowing die modules 12.

In lieu of each unit having its own pump, the entire system may have one pump mounted in line 25 which feeds all the units at once. In FIG. 1, the applicator units 10A–D shown are identical; however, different units can also be used to achieve a variety of adhesive patterns. FIG. 1 illustrates a die comprising four applicator units 10A–D, each unit having one pump 70, one actuator 20, and six meltblowing die modules 12. Thus, the applicator system 2 comprising four applicator units 10A–D contains twenty-four meltblowing modules 12.

For purposes of illustration, the components of a particular unit 10A, 10B, 10C, and 10D shown in FIG. 1 are indicated by a reference numeral with a letter (A, B, C, or D) designating the particular unit. However, in depicting and describing the structure of a unit 10, the letter designations are not used, it being understood that each unit may have the same structure.

The structure of each unit 10 is described with reference to FIGS. 2, 3, 4, and 5. Each modular melt-blowing die unit 10 of the applicator 2 comprises a manifold 11, a plurality of side-by-side self-contained die modules 12, and a valve actuator assembly including actuator 20 for controlling the polymer flow through each module. Each module 12 includes a die body 16 and a die tip assembly 13 for discharging a plurality of melt filaments 14 onto a substrate 15 (or collector). The manifold 11 distributes a polymer melt and hot air to each of the modules 12. Each of these components is described in detail below. Filaments 14 may be continuous or discontinuous strands, but generally are the latter.

Figure 4:
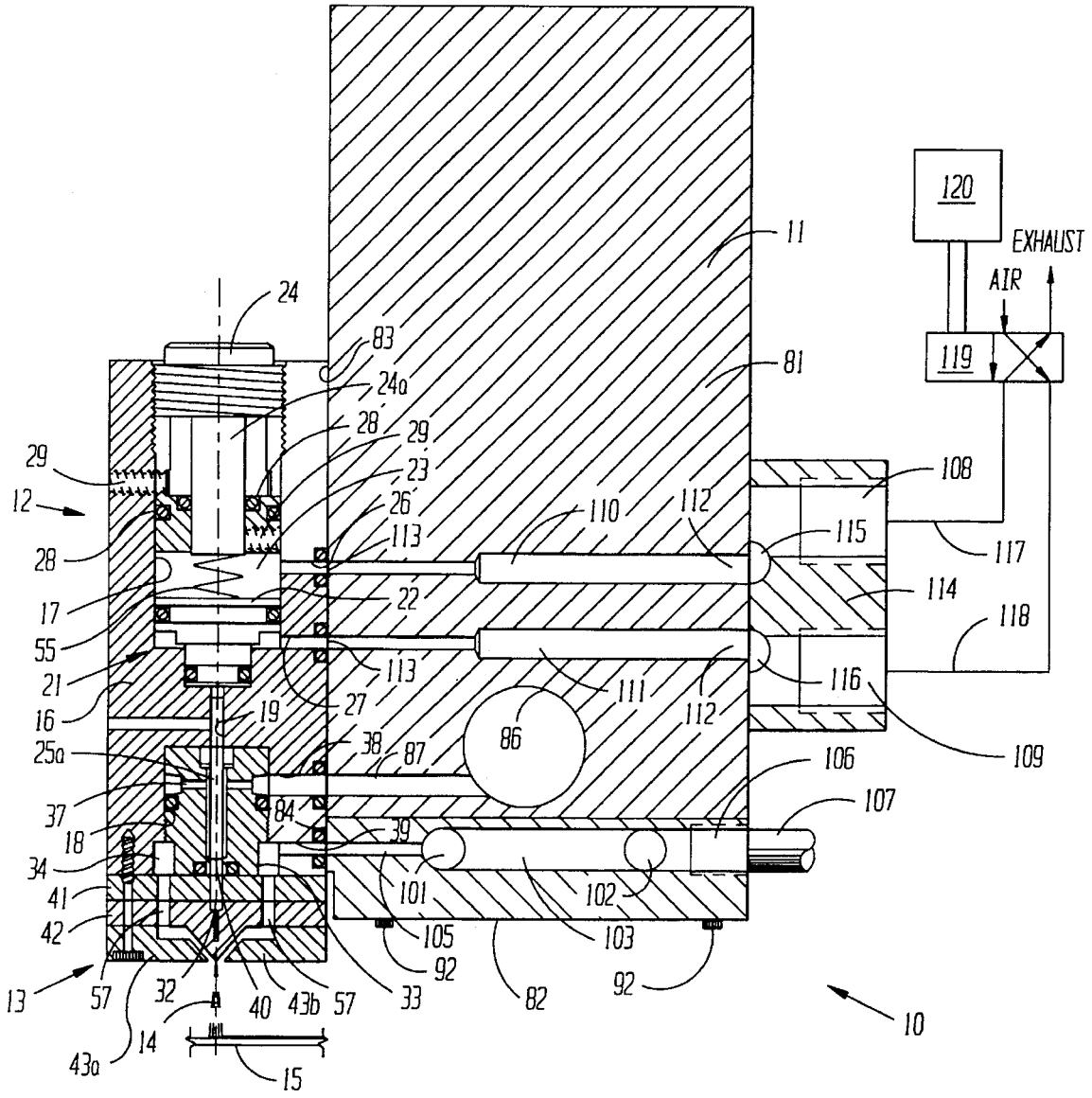
FIG. 4 is an enlarged sectional view of a die module shown in FIGS. 1, 2, and 3, with the cutting plane taken along line 4—4 of FIG. 3.

As best seen in FIG. 4, die body 16 has formed therein an upper circular recess 17 and a lower circular recess 18 which are interconnected by a narrow opening 19. The upper recess 17 defines a cylindrical chamber 23 which is closed at its top by threaded plug 24. A valve assembly 21 mounted within chamber 23 comprises piston 22 having depending therefrom stem 25*a*. The piston 22 is reciprocally movable within chamber 23, with adjustment pin 24*a* limiting the upward movement. Conventional o-rings 28 may be used at the interface of the various surfaces for fluid seals as illustrated. Threaded set screws 29 may be used to anchor cap 24 and pin 24*a* at the proper location within recess 17.

Side ports 26 and 27 are formed in the wall of the die body 16 to provide communication to chamber 23 above and below piston 22, respectively. As described in more detail below, the ports 26 and 27 serve to conduct air (referred to as instrument gas) to and from each side of piston 22.

Figure 5:
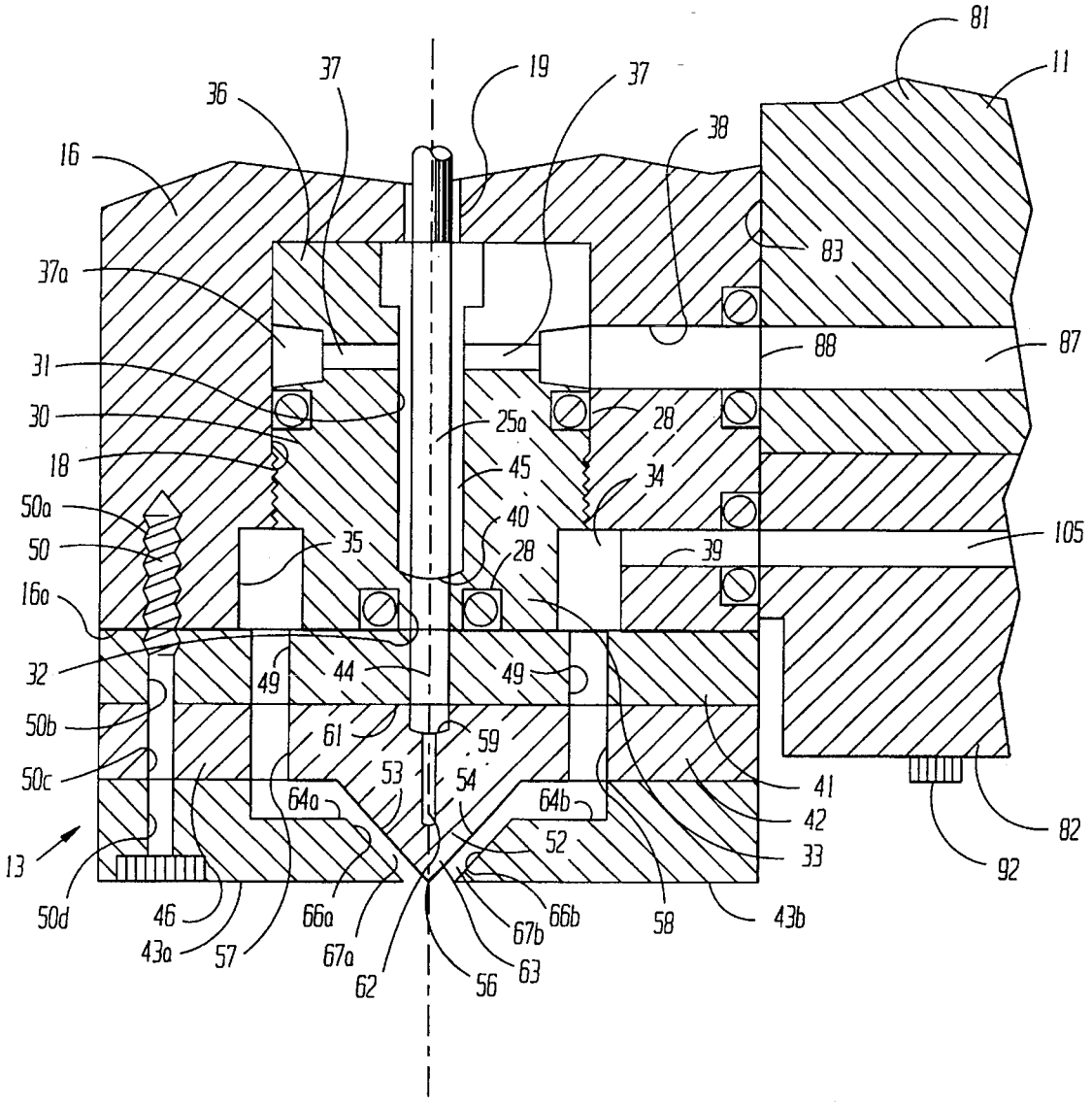
FIG. 5 is an enlarged fragmentary view of FIG. 4.

Referring to FIG. 5, lower recess 18 is formed in the downwardly facing surface 16*a* of body 16. This surface serves as the mounting surface for attaching the die tip assembly 13 to the die body 16. Mounted in the lower recess 18 is a threaded valve insert member 30 having a central opening 31 extending axially therethrough and terminating in valve port 32 at its lower extremity. A lower portion 33 of insert member 30 is of reduced diameter and in combination with die body inner wall 35 define a downwardly facing cavity 34. The die tip assembly 13 is bolted to the die body 16 using bolts 50 as shown in FIG. 5. Upper portion 36 of insert member 30 abuts the top surface of recess 18 and has a plurality (e.g. 4) of circumferential ports 37 formed therein and in fluid communication with the central passage 31. An annular recess 37*a* extends circumferentially around the upper portion 36 interconnecting the ports 37.

Valve stem 25*a* extends through body opening 19 and axial opening 31 of insert member 30, and terminates at end 40 which is adapted to seat on valve port 32. The annular space 45 between stem 25*a* and opening 31 is sufficient for polymer melt to flow therethrough. End 40 of stem 25*a* seats on port 32 with piston 22 in its lower position within chamber 23 as illustrated in FIG. 4. As discussed below, actuation of the valve 21 moves stem end 40 away from port 32 (open position), permitting the flow of polymer melt therethrough. The melt flows through side port 38, around annulus 37*a*, through ports 37, through annular space 45 discharging through port 32 into the die tip assembly 13 via port 44. Conventional o-rings 28 may be used at the interface of the various surfaces as illustrated in the drawings.

The die tip assembly 13 comprises a stack-up of four parts: a transfer plate 41, a die tip 42, and two air plates 43*a* and 43*b*. The assembly 13 can be preassembled and adjusted prior to mounting onto the die body 16.

The transfer plate 41 is a thin metal member having a central polymer opening 44 formed therein. Two rows of air holes 49 flank the opening 44 as illustrated in FIG. 5. When mounted on the lower mounting surface 16*a* of die body 16, the transfer plate 41 covers the cavity 34 (FIG. 4) and therewith defines an air chamber with the air holes 49 providing outlets for air from cavity 34. Opening 44 registers with port 32 with o-ring 28 providing a fluid seal at the interface surrounding port 32.

The die tip 42 comprises a base member 46 which is coextensive with the transfer place 41 and the mounting surface 16*a* of die body 16, and a triangular nosepiece 52 which may be integrally formed with the base. The nosepiece 52 is defined by converging surfaces 53 and 54 which meet at apex 56, which may be discontinuous, but preferably is continuous along the die. The portions of the base 46 extending outwardly from the nosepiece 52 (as viewed in FIG. 5) serve as flanges for mounting the base to the assembly and provide means for conducting the air through the base. The flanges of the base have air holes 57 and 58 and mounting holes 50*c* (one shown in FIG. 5) which register with the mounting holes 50*b* of the transfer plate 41 and 50*a* of body 16, as well as 50*d* of air plate 43*a*. The number, spacing, and positioning of the air holes 49 in the transfer plate 41 is designed so that in the assembled condition, the air holes of transfer plate 41 register with the air holes 57 and 58 of the die tip base 46.

The number of air holes formed in the transfer plate and the die tip base may vary within wide ranges, but from 5 to 10 air holes per inch as measured longitudinally along the die tip should be sufficient for most applications.

Figure 6:
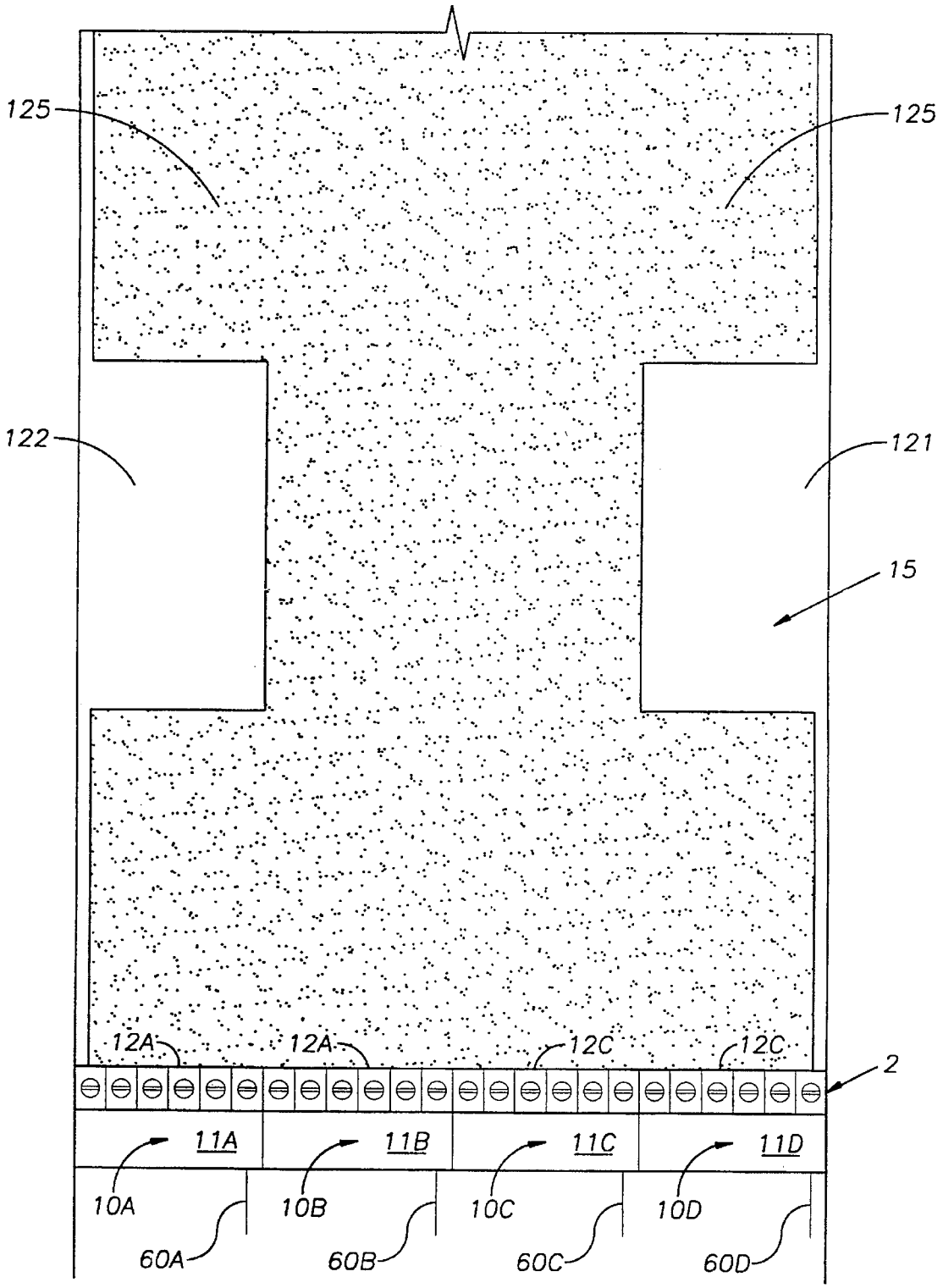
FIG. 6 is a top plan view of a diaper sheet illustrating adhesive pattern laid down thereon by the applicator system.

Although the apex 56 of the die tip 42 is discontinuous at the interface between modules 12, in the assembled position the inter-module spacing preferably is very small so the aggregate of the side-by-side modules is very similar in performance to a continuous die tip apex extending the full length of the unit 10 (see FIG. 6). The result is a meltblown product with good uniformity over the length of the unit.

Extending downwardly within the die tip 42 and coextensive with groove 59 formed in die tip 42, is an elongate channel 62. A plurality of orifices 63 formed along the apex of the nosepiece penetrate passage 62. The orifices 63 form a row of orifices spaced along the apex 56 for discharging finely divided polymer particles or filaments therefrom. The header groove 59 and channel 62 and row of orifices 63 in the apex are coextensive extending substantially the full width of the module. A very thin wall separates channels 62 of adjacent modules 12, whereby the orifice spacing across the interface of adjacent modules is essentially the same as along the modules themselves. The same is true at the interface of adjacent applicator units 10. The orifice spacing over the length of applicator 2 may be uniform and thus the performance of the applicator comprising units 10A–D may be essentially the same as for an integral die of the same overall length. As described below, the purpose of the present unitary design is to improve the flexibility of the die wherein individual units may be selectively activated to apply a coating having a preselected pattern.

In lieu or orifices, a slot may be formed extending longitudinally along the apex. The use of a slot may be preferred for processing materials with low viscosity or in applications where a large polymer throughput is required. The material discharging from a slot will generally not be in the form of finely divided filaments as in the case of orifices 63. However, for continuity the material discharged from a slot will be referred to as filaments since converging air sheets will tend to disperse the polymer into filament-like segments.

Air plates 43*a* and 43*b* are in flanking relationship to the nosepiece and include confronting converging surfaces 66*a* and 66*b*. These surfaces in combination with the converging surfaces 53 and 54 of the nosepiece 52 define converging air slits 67*a* and 67*b* which meet at the apex 56. The inner surfaces of each air plate are provided with recesses 64*a* and 64*b* which are aligned with air holes 57 and 58 in base 46. Air is directed to opposite sides of the nosepiece into the converging slits and discharged therefrom as converging air sheets.

The assemblage of the four components 41, 42, and 43*a* and 43*b* of the die tip assembly 13 may be accomplished by aligning up the parts and inserting bolts 50 through clearance holes 50*b*, 50*c*, and 50*d* into the threaded hole 50*a*. Tightening bolt 50 maintains the alignment of the parts. Alternatively, the die tip assembly may be preassembled before attaching to body 16 by countersunk bolts extending downwardly from the transfer plate, through the die tip, and into the air plates with the base of the die tip sandwiched therebetween. The assemblage may then be attached to body 16 using bolts 50. This is the design disclosed in U.S. Pat. No. 5,145,689, the disclosure of which is incorporated herein by reference.

Note that the interface between the three components of the die tip assembly do not need seals because the machine surfaces provide a seal themselves. It should also be observed that for purposes of this invention, the transfer plate may be considered a part of the base of the die tip 42. A transfer plate 41 is used merely to facilitate the construction of the die tip assembly.

As best seen in FIG. 4, the manifold 11 is constructed in two parts: an upper body 81 and a lower body 82 bolted to the upper body by spaced bolts 92. The upper body 81 and lower body 82 have mounting surfaces 83 and 84, respectively, which lie in the same plane for receiving modules 12.

Figure 3:
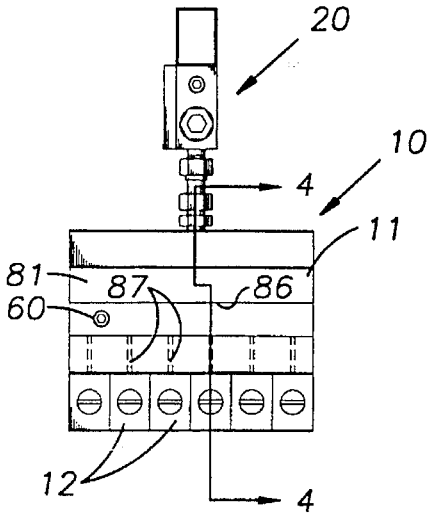
FIG. 3 is a partial top view of the die assembly shown in FIGS. 1 and 2.

As shown in FIGS. 3, 4, and 5, the upper body manifold 81 has formed therein polymer header passage 86 extending longitudinally along the interior of body 81 and side feed passages 87 spaced along the header passage 86 for delivering polymer to each module 12. The polymer feed passages 87 have outlets 88 which register with passage 38 of its associated module 12 (FIG. 5). The polymer header passage 86 has an inlet which is fed by line 60 (FIG. 3) A polymer melt delivered to the die assembly flows from line 60 through passage 86 and in parallel through the side feed passages 87 to the individual modules 12. A single feed line 60 is used to feed each module 12 of unit 10 via a single feed manifold line 86. As seen in FIG. 1, each dispersing unit 10A–D has associated feed line 60A–D connected to main line 25 across pumps 70A–D. Pumps 70 may be gear pumps for pressurizing the polymer at a precise rate. Alternatively, a single pump may be placed in main line 25 for driving all units 10A–D together. Pumps 70A–D feed unit manifolds 11A–D in parallel.

Air is delivered to the modules through the lower block 82 of the manifold 11 as shown in FIGS. 4 and 5. The air passages in the lower block 82 are in the form of a network of passages comprising a pair of passages 101 and 102 interconnecting a plurality of side ports 103, and module air feed ports 105 longitudinally spaced along bore 101. Air inlet passage 106 connects to air feed line 107 near the longitudinal center of block 82. Air feed ports 105 register with air passage 39 and module 12.

Heated air enters body 82 through line 107 and inlet 106. The air flows through passage 102, through side passages 103, into passage 101, and in parallel through module air feed ports 105. The network design of manifold 82 serves to balance the air flow longitudinally over the length of the die.

Referring to FIG. 4, the instrument air for activating valve 21 is delivered to the chamber 23 of each module 12 by air passages formed in the block 81 of manifold 11. Instrument air passages 110 and 111 extend through the width of body 81 and each has an inlet 112 and an outlet 113. Outlet 113 of passage 110 registers with port 26 formed in module 12 which leads to chamber 23 above piston 22; and outlet 113 of passage 111 registers with port 27 of module 12 which leads to chamber 23 below piston 22.

Figure 2:
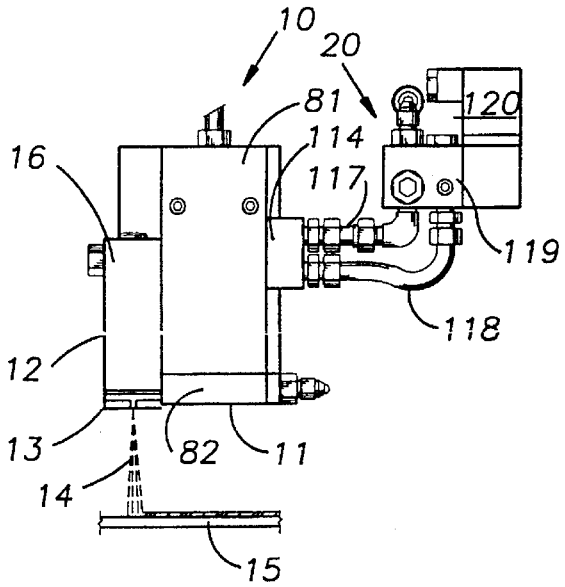
FIG. 2 is a side elevational view of the die assembly shown in FIG. 1.

An instrument air block 114 is bolted to block 81 and traverses the full length of the instrument air passages 110 and 111 spaced along body 81. The instrument air block 114 has formed therein two longitudinal channels 115 and 116 whereby it may serve all modules 12 of unit 10. With the block 114 bolted to body 81, channels 115 and 116 communicate with the instrument air passages 110 and 111, respectively, of all modules 12. Referring to FIGS. 2 and 4, instrument tubing 117 and 118 (shown schematically in FIG. 4) deliver instrument air from control valve 119 to flow ports 108 and 109 which feed channels 115 and 116 in parallel. Channels 115 and 116 feed ports 110 and 111 in parallel. Actuator 20 comprises 3-way solenoidal air valve 119 coupled with lines 117 and 118 and having electronic controls 120.

Each module 12 is thus provided with internal valve 21, whereas each unit 10 is provided with actuator 20 for controlling the flow of polymer through the modules. The valve and valve actuator are similar in construction to those disclosed in U.S. Pat. No. 5,269,670, the disclosure of which is incorporated herein by reference.

The valve 21 of each module 12 is normally closed with the chamber 23 above piston 22 being pressurized and chamber 23 below piston 22 being vented through valve control 119. Spring 55 also acts to maintain the closed position. To open the valves 21 of the modules 12, the 3-way control valve 119 is actuated by controls 120 sending instrument gas through tubing 118, channel 116, through passage 111 and port 27 to pressurize chamber 23 below piston 22, and while venting chamber 23 above piston 22 through port 26, passage 110, channel 115 and tubing 117. The excess pressure below piston 22 moves the piston and stem 25*a* upward opening port 32 to permit the flow of polymer therethrough.

In a preferred embodiment, all of the valves of an applicator unit 10 are activated simultaneously using a single valve actuator 20 so that polymer flows through all the modules 12 in parallel, or there is no flow at all through the unit. In other embodiments, individual modules or groups of modules may be activated using multiple actuators 20 spaced along the die. In this embodiment, multiple instrument blocks 114 for driving groups of modules would also be required. It would likewise be possible to drive groups of applicator units using a single actuator.

A particularly advantageous feature of the present invention is that it permits the construction of a melt-blowing die with a wide range of possible lengths using standard sized manifolds and interchangeable, self-contained modules. Variable die length may be important for coating substrates of different sizes from one application to another. The following sizes and numbers are illustrative of the versatility of modular construction.

| Die Assembly | Broad Range | Preferred Range | Best Mode |
|---|---|---|---|
| Number of Modules | 3–1,000 | 5–100 | 10–50 |
| Length of Modules (inches) | 0.25–1.50" | 0.5–1.00" | 0.5–0.8" |
| Orifice Diameter (inches) | 0.005–0.050" | 0.01–0.040" | 0.015–0.030" |
| Orifices per inch | 5–50 | 10–40 | 10–30 |

Depending on the desired length of the die, standard sized manifolds may be used. For example, a die length of one meter could employ 54 modules mounted on a manifold 40 inches long. For a 20 inch die length 27 modules would be mounted on a 20 inch length manifold.

The die applicator 2 may also include electric heaters (not shown) and thermocouples (not shown) for heat control as well as other instruments. In addition, air supply line 107 may be equipped with an in-line electric or gas heater. Main line 25 and/or applicator assembly 2 may be equipped with heaters which are adjusted to provide sufficient heating whereby the temperature of the melt between the discharge of the extruder to the discharge of the applicator never falls below 20° to 70° F. above the melting point of the polymer.

As indicated above, the modular die assembly can be tailored to meet the needs of a particular operation. FIG. 1, six modules 12, each 0.74 inches in width, are mounted on 4.5 inch long manifolds 11A–D. The four manifolds 11A–D combine into a die assembly having an overall length of approximately 18 inches. The lines, instruments, and controls are connected and operation commenced. A hot melt adhesive is delivered to the die through line 25, hot air is delivered to the die through line 107, and instrument gas is delivered through lines 117 and 118.

Actuation of the control valves opens port 32 as described previously, causing polymer melt to flow through each module. The melt flows in parallel through manifold passages 87, through side ports 38, through passages 37 and annular space 45, and through port 32 into the die tip assembly via passage 44. The polymer melt is distributed laterally in header channels 59 and 62 and discharges through orifice 63 as side-by-side filaments 14. Air meanwhile flows from manifold passage 105 into port 39 through chamber 34, holes 49, 57, and 58, and into slits 67*a* and 67*b* discharging as converging air sheets at or near the die tip apex 56. The converging air sheets contact the filaments discharging from the orifices and by drag forces stretch them and deposit them onto an underlying substrate 15 in a random position. This forms a generally uniform layer of meltblown material on the substrate.

Typical operational parameters are as follows:

| | |
|---|---|
| Polymer | Hot melt adhesive |
| Temperature of the Die and Polymer | 280° F. to 350° F. |
| Temperature of Air | 280° F. to 370° F. |
| Polymer Flow Rate | 0.1 to 10 grms/hole/min. |
| Hot Air Flow Rate | 0.1 to 2 SCFM/inch |
| Deposition | 0.05 to 500 g/m$^2$ |

Diaper Backsheet Embodiment

As indicated above, the present invention is particularly adapted for applying a hot melt adhesive onto a diaper layer such as a backsheet, for gluing the backsheet and other diaper layer such as an absorbent together. The applicator is positioned above the conveyor layer 15. A diaper backsheet 125 (see FIG. 6), having cut-out portions 121 and 122, is conveyed on conveyor 15 and applicator 2 meltblows a thin pattern of adhesive onto the backsheet in a preselected pattern.

The applicator initially meltblows the adhesive on the full width of the diaper backsheet using all units 10A–10D. However, as the cut-out portions 121 and 122 pass under the applicator 2, units 10A and 10D are shut off while units 10C and 10D continue to apply adhesive to the central portion of the backsheet. When the cutouts 121 and 122 clear the applicator, units 10A and 10D are again activated, whereby adhesive is applied to the full width of the diaper backsheet.

It will be appreciated by those skilled in the art that the preselected patterns may vary depending on the number of units and modules of each unit. More elaborate patterns such as an hourglass shape are possible with the correct combination of modules and actuators.

Operation

In operation, the raw materials are metered (via weigh feeds 8*a* and 8*b*) from hoppers 7*a* and 7*b*, into extruder hopper 4. The raw materials are mixed and compounded in extruder 3 and discharged from extruder outlet 6 as a homogeneous melt. The melt is conducted to the applicator 2 by heated main line 25. Pumps 70A–D feed the melt into each unit 10A–D. The valve actuators 20A–D are selectively activated to obtain the desired adhesive pattern on the substrate. In the illustration of FIG. 1, all of the valves are open so that polymer flows through each unit 10A–D, to deposit adhesive continuously across the substrate 15.

The operation from raw material feed to deposition of the substrate is continuous and occurs in a very short period of time (e.g. from 1 to 30 minutes). The method thus avoids any risk of polymer degradation or contamination. Moreover, very little, if any, antioxidant is required. Another particularly attractive feature of the present invention it that it permits changing the formulation "on the run". That is, if conditions change requiring a different mix or adjustment of the formulations the ratio of the raw material ingredients or the addition of other additives may be introduced into the extruder. Microprocessing controls can be used to monitor and maintain precise control of the operations.

EXAMPLE

A specific example of apparatus and materials for carrying out the method of the present invention is as follows:

(a) Extruder Assembly (1)
- Weigh feeder
- Model 7E254320 Twin Screw Extruder, intermesh corotation (electrically heated), manufactured by Berstoff
- Rpm: 1–550
- Stages: 1–4
- L/P: 6 (150 mm length)
- Output rate: 5 to 75 lbs./hr.
- Temperature range: up to 750° F.
- Motor: 15 hp 2500 rpm
- Programmed Logic Control (b) Applicator System (2)
- J&M meltblown adhesive applicator (Model Durafiber) having output of 1–20 gpm/module with 0.68 to 2.92 gear pump rating.

(c) Line
- Insulated and heated line marketed by J&M Laboratories, capable of maintaining a temperature of 400° F.

(d) Raw Materials
- Vector—particulate polymer marketed by Exxon Chemical Company.
- ESCOREZ—particulate tackifier resin marketed by Exxon Chemical Company.

The polymer is placed in hopper 7*a* and particulate resin is placed in hopper 7*b*. The feeders 8*a* and 8*b* are operated to feed the polymer and resin into hopper 4 in a weight ratio of 20:60. The residence time in the extruder is 1–30 minutes.

The meltblown dies are operated at the following conditions:

- Pump feed: 1.0 to 800 gpm
- Polymer Temperature: 325° F.
- Extrusion rate: 4–10 grams per hole
- Pressure: 150–500 psi
- Orifice size: 0.02–0.03 mils
- Orifices per inch: 10–20
- Air rate: 150–250 CFM/inch
- Air temperature: 350°–450° F.

The filaments have an average diameter of 60–100 microns and are randomly deposited on the substrate forming a thin uniform pattern on the substrate of 0.5 to 20 g/m$^2$, preferably 3–5 g/m$^2$.

The system may be provided with bypass or return lines to the extruder so that the extruder output will exceed the demand rate of the applicators thereby providing a positive feed to the applicators. Also, accumulator tanks can be provided to maintain excess demand.

What is claimed is:

1. An in-line continuous method of formulating and applying a hot melt adhesive to a substrate which comprises the steps of:

(a) continuously metering into an extruder raw materials comprising particles of a polymer adhesive and a tackifier resin in the proper weight ratio;

(b) heating and mixing the raw materials in the extruder to form a homogeneous melt of the raw materials;

(c) continuously discharging the melt from the extruder directly into an applicator system comprising a plurality of air assisted applicators, each applicator having a pump and an applicator head; and (d) discharging the melt from the applicator heads onto a substrate.

2. The method of claim 1 wherein the polymer adhesive is selected from the group consisting of block copolymer adhesives, EVA copolymer adhesives, and polyolefin adhesives.

3. The method of claim 2 wherein the polymer adhesive is selected from the group consisting of EVA, SIS, SBS, polyolefins, polyurethane, and EMA.

4. The method of claim 1 wherein the polymer and resin raw materials are in a weight ratio ranging from 10:90 to 2:1.

5. The method of claim 1 wherein the extruder is a twin screw extruder.

6. The method of claim 1 wherein the rate of discharge from the extruder ranges from 5 to 75 pounds per hour.

7. The method of claim 1 wherein the tackifier resin is selected from the group consisting of hydrocarbon resin and tall oil resin esters.

8. The method of claim 1 wherein the temperature of the melt between the discharge of the extruder to the discharge of the applicator head never falls below 20°–50° F. above the melting point of the polymer.

9. The method of claim 1 wherein the applicator head is a meltblown applicator.

10. The method of claim 1 wherein the raw materials are particulates and are introduced into the feed opening of the extruder.

11. The method of claim 1 comprising the further step of continuously metering third raw material selected from the group of plasticizers, waxes, antioxidants, and oils into the extruder.

12. The method of claim 11 wherein at least one of the raw materials is introduced into a side opening of the extruder.

13. A method of continuously formulating and applying a hot melt adhesive to a diaper layer, which comprises:

(a) continuously metering into an extruder raw materials comprising particles of a polymer adhesive and a tackifier resin in a weight ratio of 10:90 to 50:50;

(b) continuously heating and mixing the raw materials in the extruder to form a homogeneous melt of the raw materials;

(c) continuously discharging the melt from the extruder into an applicator system comprising a plurality of air-assisted and intermittently operated applicator heads;

(d) discharging the hot melt adhesive from the applicator heads onto a diaper layer in a pattern.

14. The method of claim 13 comprising the further step of pressurizing an air driven actuator valve for intermittently operating the applicator heads.

* * * * *